US010247047B2

(12) United States Patent
Bini et al.

(10) Patent No.: US 10,247,047 B2
(45) Date of Patent: Apr. 2, 2019

(54) CONTROL METHOD FOR AN ORGANIC RANKINE CYCLE

(71) Applicant: TURBODEN S.R.L., Brescia (IT)

(72) Inventors: Roberto Bini, Brescia (IT); Claudio Pietra, Brescia (IT); Davide Colombo, Milan (IT)

(73) Assignee: Turboden S.p.A., Brescia (IT)

( * ) Notice: Subject to any disclaimer, the term of this patent is extended or adjusted under 35 U.S.C. 154(b) by 148 days.

(21) Appl. No.: 15/033,895

(22) PCT Filed: Dec. 15, 2014

(86) PCT No.: PCT/IB2014/066910
§ 371 (c)(1),
(2) Date: May 2, 2016

(87) PCT Pub. No.: WO2015/092649
PCT Pub. Date: Jun. 25, 2015

(65) Prior Publication Data

US 2016/0265391 A1 Sep. 15, 2016

(30) Foreign Application Priority Data

Dec. 19, 2013 (IT) ..... BS2013A0184

(51) Int. Cl.
*F01K 13/02* (2006.01)
*F01K 11/02* (2006.01)
*F01K 25/08* (2006.01)

(52) U.S. Cl.
CPC ..... *F01K 13/02* (2013.01); *F01K 11/02* (2013.01); *F01K 25/08* (2013.01)

(58) Field of Classification Search
CPC ..... F01K 11/02; F01K 13/02; F01K 25/08
See application file for complete search history.

(56) References Cited

U.S. PATENT DOCUMENTS

2011/0271676 A1 11/2011 Walpita et al.
2011/0308252 A1 12/2011 Kopecek

FOREIGN PATENT DOCUMENTS

WO WO 2012/110905 A1 8/2012

*Primary Examiner* — Audrey K Bradley
(74) *Attorney, Agent, or Firm* — R. Ruschena Patent Agent, LLC

(57) ABSTRACT

An embodiment of the present invention is a method of controlling an Organic Rankine Cycle system, the system comprising at least one feed pump (2), at least one heat exchanger (3), an expansion turbine (5) and a condenser (6), the organic Rankine Cycle comprising a feeding phase of an organic working fluid, a heating and vaporization phase of the same working fluid, an expansion and condensation phase of the same working fluid, wherein said method controls an adjusted variable (X), which is a function of an overheating of the organic fluid, by means of a controller (20) that acts by varying a control variable (Y), which is a parameter of the organic fluid in its liquid phase, and wherein the adjusted variable (X) is a temperature difference (ΔT) between a current temperature of the organic fluid in vapor phase at the turbine inlet and a temperature threshold (Tlim), under which the expansion phase involves the formation of a liquid phase of the organic fluid.

8 Claims, 4 Drawing Sheets

CONTROL METHOD FOR AN ORGANIC RANKINE CYCLE

FIELD OF THE INVENTION

The present invention is related to a control method for vapor thermodynamic cycles and is particularly suitable for an organic Rankine cycle (hereafter also ORC).

BRIEF DESCRIPTION OF THE PRIOR ART

As known, a thermodynamic cycle is a cyclical finite sequence of thermodynamic transformations (for example, isotherm, isochoric, isobar or adiabatic). At the end of each cycle the system comes back to its initial state. In particular, a Rankine cycle is a thermodynamic cycle composed of two adiabatic transformations and two isobar transformations. Aim of the Rankine cycle is to transform heat in mechanical work and all kind of vapor machines are based on such a cycle. This cycle is mainly used in thermo-electrical plants for electrical energy production and uses water as working fluid, both in liquid and in vapor state, in the so called vapor turbine.

Organic Rankine cycles (ORC), using organic fluid having a high molecular mass, have been realized for a huge number of applications, in particular also for using thermal sources, having low-meddle enthalpy values. As for other vapor cycles, an ORC apparatus comprises one or more pumps for the organic fluid feeding, one or more heat exchangers for performing pre-heating, vaporization and eventually overheating, a vapor turbine for expanding the fluid, a condenser for transforming the vapor into liquid and in some cases a regenerator for heat recovering, downstream of the turbine, i.e. upstream of the condenser.

With respect to steam cycles, one of the advantages of ORC cycles is that organic fluids, having a high molecular mass, show a saturation curve (in the graph temperature-entropy, T-S) with a right branch 12' having a positive slope (FIG. 2). Instead, the steam saturation curve shows a right branch 11' having a negative slope (FIG. 1-).

As a consequence, even expanding saturated vapor in the turbine, the vapor expansion does not fall inside the saturation curve, but outwards, in the overheated vapor area. Therefore, during the expansion in the turbine, there is no liquid formation, which can damage the turbine or at least worsen the turbine efficiency.

On the other hand, if the evaporation pressure is close to the fluid critical pressure or even higher (hypercritical cycle, (FIG. 3) and at the same time the fluid temperature is not high enough, it can happen that the expansion curve of the vapor in the turbine, in the T-S diagram, intersects the saturation curve: in this case, there is liquid formation in the turbine also for ORC cycles, as shown in FIG. 3, reference 15'.

The intersection can arise in the upper portion of the right branch of the saturation curve—quasi-critical or hypercritical cycles (FIG. 3)—or in the lower portion of the right branch, in case of organic fluids having a lower molecular mass, which can have the right branch of the saturation curve either with a small positive slope or even with a small negative slope.

Therefore, there is the need of a new control method for ORC cycles, which avoids any turbine expansion falling inside the saturation curve, in other words, any liquid formation during the expansion, with consequent worsening of the lifetime and the efficiency of the turbine.

SUMMARY OF THE INVENTION

An aspect of the present invention is a control method for ORC cycles, said method controlling the liquid supply to the heat exchangers of the high pressure portion of the ORC cycle, in order to avoid the mentioned inconvenience.

Another aspect of the invention is an apparatus configured to execute the above method.

A first aspect of the invention is a method of controlling an organic Rankine Cycle system, the system comprising at least one feed pump, at least one heat exchanger, an expansion turbine and a condenser, the organic Rankine cycle comprising a feeding phase of an organic working fluid, a heating and vaporization phase of the same working fluid, an expansion and condensation phase of the same working fluid, eventually a regeneration phase, wherein said method controls an adjusted variable, hereafter defined as "similar to an overheating" of the organic fluid by means of a controller that acts by varying a control variable, which is a parameter of the organic fluid in its liquid phase. In particular, said adjusted variable is a temperature difference between a current temperature of the organic fluid in vapor phase at the turbine inlet and a temperature threshold under which the expansion phase involves the formation of a liquid phase of the organic fluid.

Consequently, an apparatus is described, the apparatus being configured to realize the above method and comprising means for controlling said adjusted variable, "similar to a overheating" of the organic fluid, said means acting by varying a control variable, which is a parameter of the organic fluid in its liquid phase, wherein said adjusted variable is a temperature difference between a current temperature of the organic fluid in vapor phase at the turbine inlet and a temperature threshold under which the expansion phase involves the formation of a liquid phase of the organic fluid.

An advantage of this aspect is that the difference between a current temperature of the organic fluid in vapor phase at the turbine inlet and a temperature threshold under which the expansion phase involves the formation of a liquid phase of the organic fluid can be easily determined, when the thermodynamic characteristics of the organic fluid are known as a function of the supply pressure of said fluid and, for certain organic fluids, also as a function of the condensation pressure. In this way, during the expansion in the turbine, the liquid formation is avoided, and consequently the risk to worsen the turbine efficiency.

According to another embodiment, said control variable is the flow rate of the organic fluid at the inlet of said at least one heat exchanger.

Consequently, said control means are configured for acting on the flow rate of the organic fluid at the inlet of said at least one heat exchanger.

An advantage of this embodiment is to keep the adjusted variable equal to the predetermined set-point, by means of the adjustment of the flow rate of the organic fluid.

According to a further embodiment, the adjustment of the flow rate of the organic fluid at the inlet of the heat exchanger is realized by varying the rotational speed of the feed pump of the organic fluid.

Consequently, said control means are configured for varying the rotational speed of the feed pump of the organic fluid.

An advantage of this embodiment is that the rotational speed of the feed pump can be easily controlled.

According to still another embodiment, the adjustment of the flow rate of the organic fluid at the inlet of the heat exchanger is realized by varying the opening degree of a valve, located downstream of the feed pump of the organic fluid.

Consequently, said control means are configured for varying the opening degree of a valve, located downstream of the feed pump of the organic fluid.

An advantage of this embodiment is to execute an alternative flow rate adjustment, if the feed pump of the organic fluid operates at fixed revolution number. According to another aspect of the invention an organic Rankine cycle system is disclosed, the system comprising at least one feed pump, at least one heat exchanger, an expansion turbine, a condenser and a controller configured to operate a method according to one of the above embodiments.

The method according to one of its embodiments can be carried out with the help of a computer program comprising a program-code for carrying out all the steps of the method described above, and in the form of computer program product comprising the computer program.

The computer program product can be configured as a control apparatus for an organic Rankine cycle, comprising an Electronic Control Unit (ECU), a data carrier, associated to the ECU, and a computer program stored in the data carrier, so that the control apparatus defines the embodiments described in the same way as the method. In this case, when the control apparatus executes the computer program all the steps of the method described above are carried out.

BRIEF DESCRIPTION OF THE DRAWINGS

The invention will be now described by reference to the enclosed drawings, which show some non-limitative embodiments, namely.

DETAILED DESCRIPTION OF THE PREFERRED EMBODIMENTS

Figure 7:
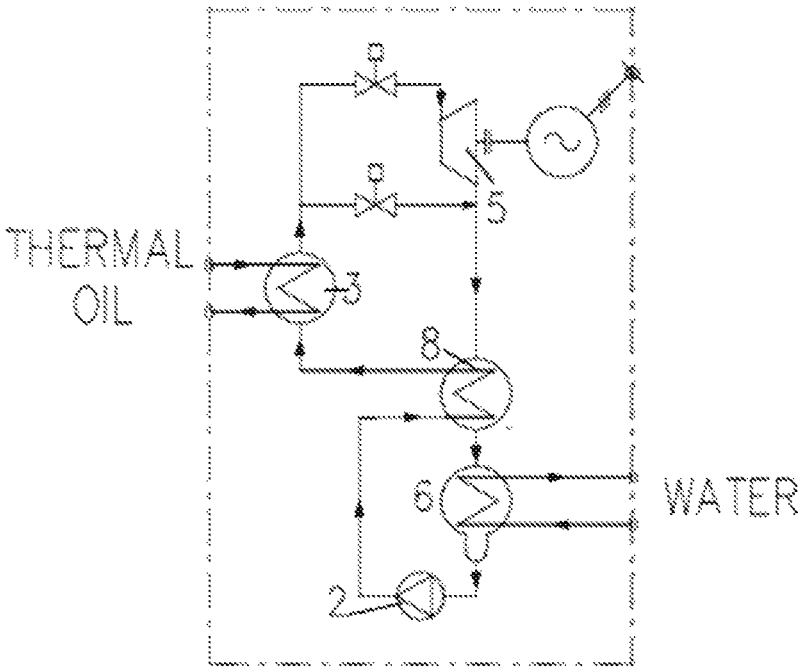
FIG. 7 schematically represents an ORC system, for which the present method can be utilized.

With reference to FIG. 7, an ORC system typically comprises at least a feed pump 2 for supplying an organic fluid in liquid phase to at least a heat exchanger 3. In the heat exchanger, which on its turn can comprise a pre-heater, an evaporator and an over-heater, the organic fluid is heated until the transformation in saturated vapor or even in overheated vapor happens. After exiting the heat exchanger, the vapor crosses an expansion turbine (where the mechanical work of the ORC cycle is obtained) and finally crosses a condenser 6, which transforms the vapor into liquid, and can come back to the feed pump for the subsequent cycle. Advantageously, between the turbine 5 and the condenser 6, a regenerator 8 can be provided. The regenerator 8 exchanges heat between the organic fluid in liquid phase, flowing from the feed pump to the heat exchanger, and the organic fluid in vapor phase, flowing towards the condenser.

Figure 1:
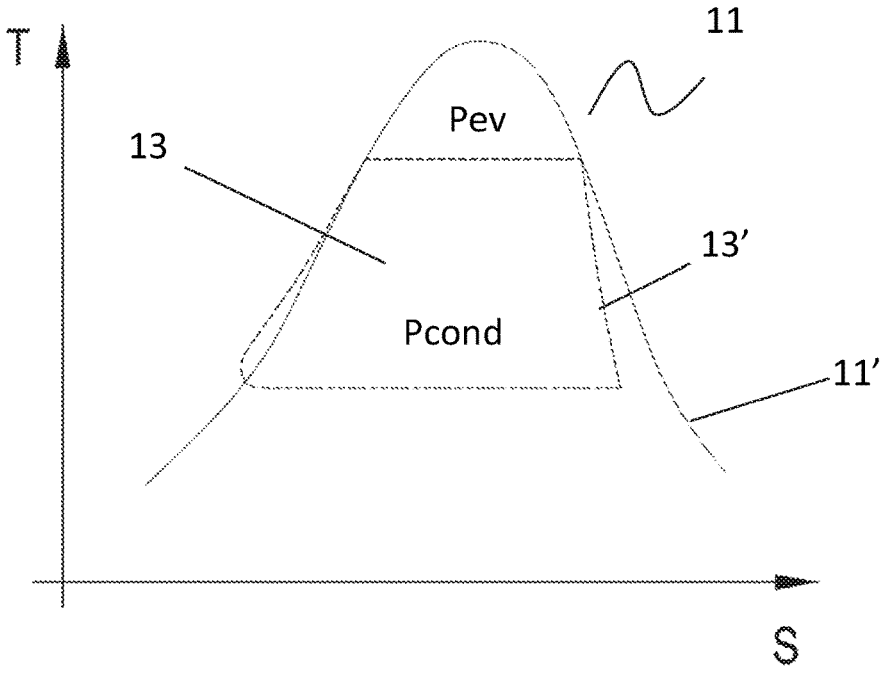
FIG. 1 shows in the diagram temperature-entropy a thermal cycle of an inorganic fluid, having a low molecular mass.
Figure 2:
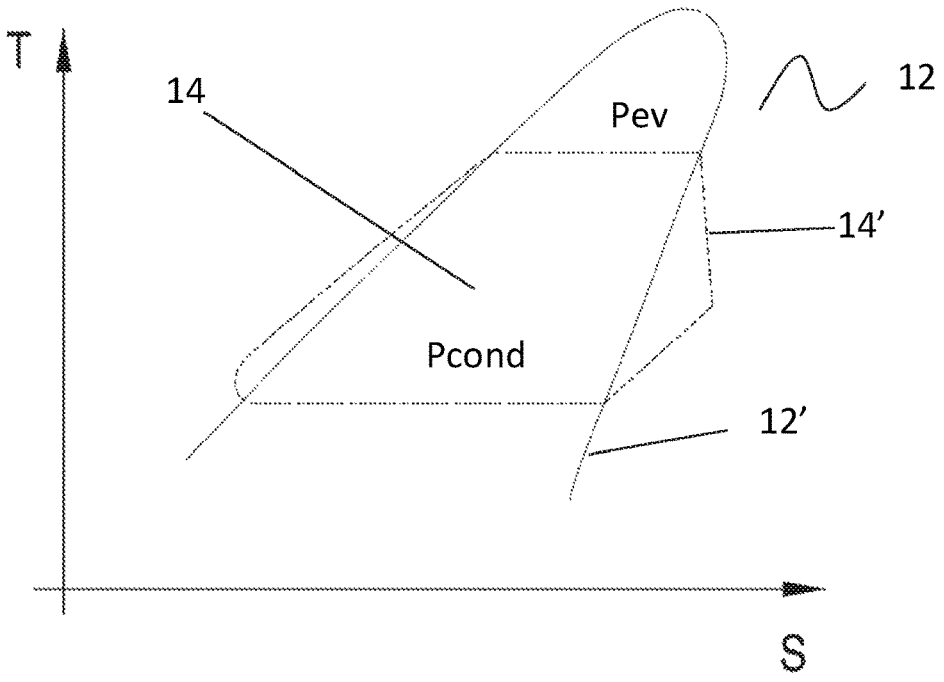
FIG. 2 shows in the diagram temperature-entropy a thermal cycle of an organic fluid, having a high molecular mass.

With reference to FIGS. 1-2, representing a thermodynamic diagram of the temperature as a function of the entropy (T-S diagram), the substantial difference between a saturation curve 12 of an organic fluid (having a middle or high molecular mass, with respect to the water molecular mass) and a saturation curve 11 of the water is that for the organic fluid the right branch 12' of the curve shows a positive slope, while for the water-steam system the right branch 11' of the curve shows a negative slope. A typical cycle, without overheating, i.e. with a saturated vapor expansion, is respectively referenced with 13 (steam cycle, FIG. 1) and with 14 (ORC cycle, FIG. 2). Due to the different shape of the saturation curve, the two cycles differ because the steam expansion 13' in the turbine fall inside its own saturation curve, with liquid formation, while the organic fluid expansion 14' in the turbine arises outside the saturation curve, that is to say in the overheated vapor area. Therefore, during the turbine expansion, there is no liquid formation and, consequently, no turbine damage.

Figure 3:
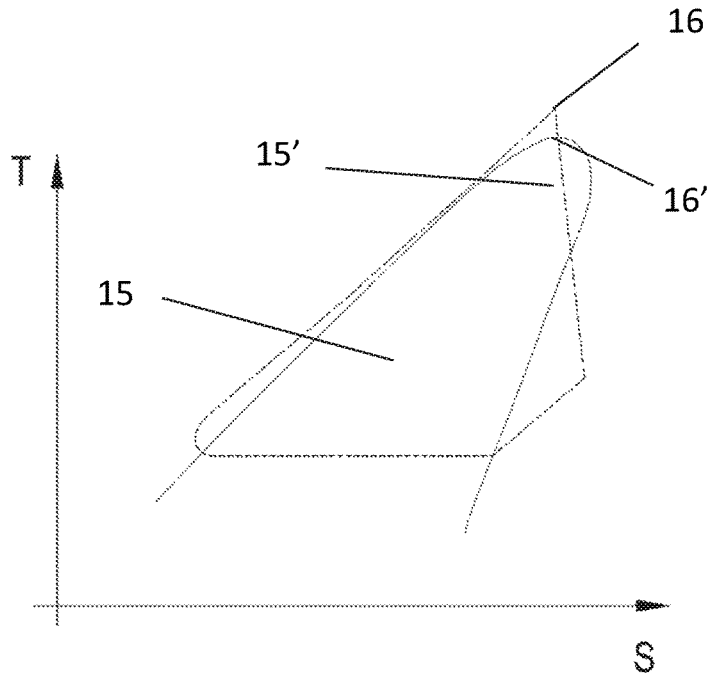
FIG. 3 shows in the diagram temperature-entropy a hypercritical thermal cycle of the organic fluid of FIG. 2.

On the other hand, in some cases, such an advantage of the ORC fluids is not available. For example, FIG. 3 shows a hypercritical thermodynamic cycle 15 of an organic fluid (it can be the same as in FIG. 2). The cycle is called hypercritical, since the evaporation pressure at the expansion start 16 is higher than the pressure of the critical point 16'. In this case or in case of subcritical cycles (though in presence of saturated vapor, the cycle operates close to the critical point, that is to say with an evaporation pressure very similar to the critical pressure of the fluid) the expansion curve 15' of the vapor in the turbine can intersect the saturation curve of the T-S diagram and therefore, also for ORC cycles there is liquid formation in the turbine.

The present invention starts considering that for each feeding pressure value of the vapor in the turbine, there is a temperature threshold Tlim, under which the expansion would intersect the saturation curve. On the contrary, if a higher temperature than this temperature threshold is kept, the expansion in the turbine takes place in a safety area, in other words in the overheated vapor area, without intersecting the saturation curve.

Figure 4:
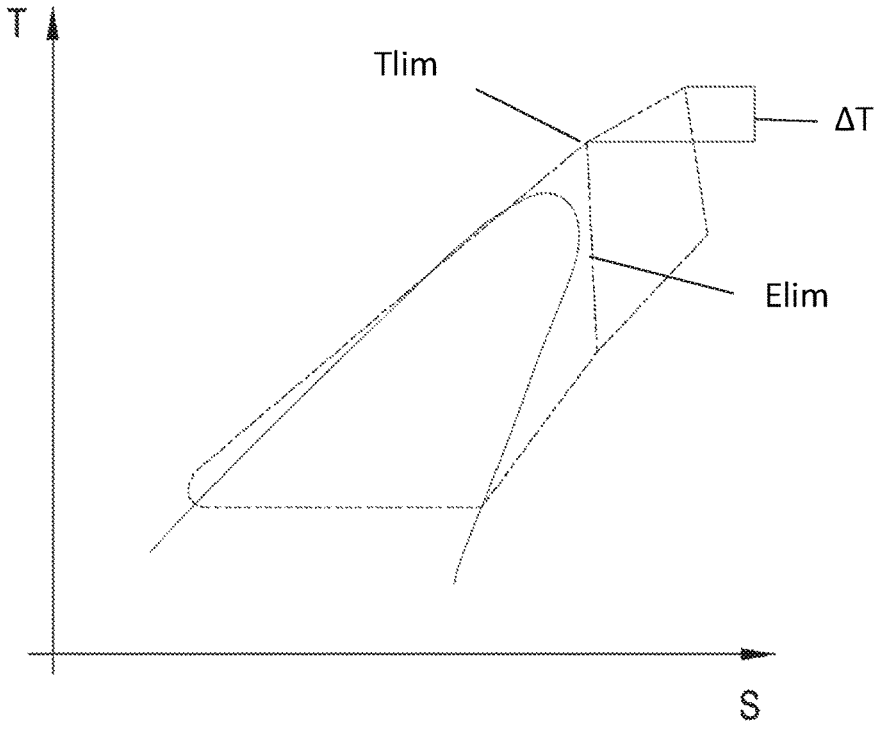
FIG. 4 shows in the diagram temperature-entropy a hypercritical thermal cycle of the organic fluid of FIG. 2, having defined an adjusted variable "similar to an overheating" according to an embodiment of the present method.

With reference to FIG. 4, the temperature difference $\Delta T$ between the vapor temperature at the turbine inlet and this temperature threshold Tlim is called "similar to an overheating". In other words, such parameter "similar to an overheating" represents a safety margin with respect to the critical condition, which would cause liquid formulation during the expansion in the turbine. This condition is expressed by the temperature threshold Tlim, to whom an expansion phase Elim tangent to the saturation curve corresponds. A map or a theoretical-experimental curve can be defined, associating for each pressure value in the turbine a corresponding temperature threshold. For each point, such temperature threshold can be calculated, simulating the vapor expansion in the turbine. It can be observed that, in case of subcritical cycles, for a certain portion of the expansion curve, such couples of points are the couples saturation pressure—saturation temperature of the fluid, since that, in this expansion curve portion the saturation temperature ensures not to have expansion inside the saturation curve.

Figure 5:
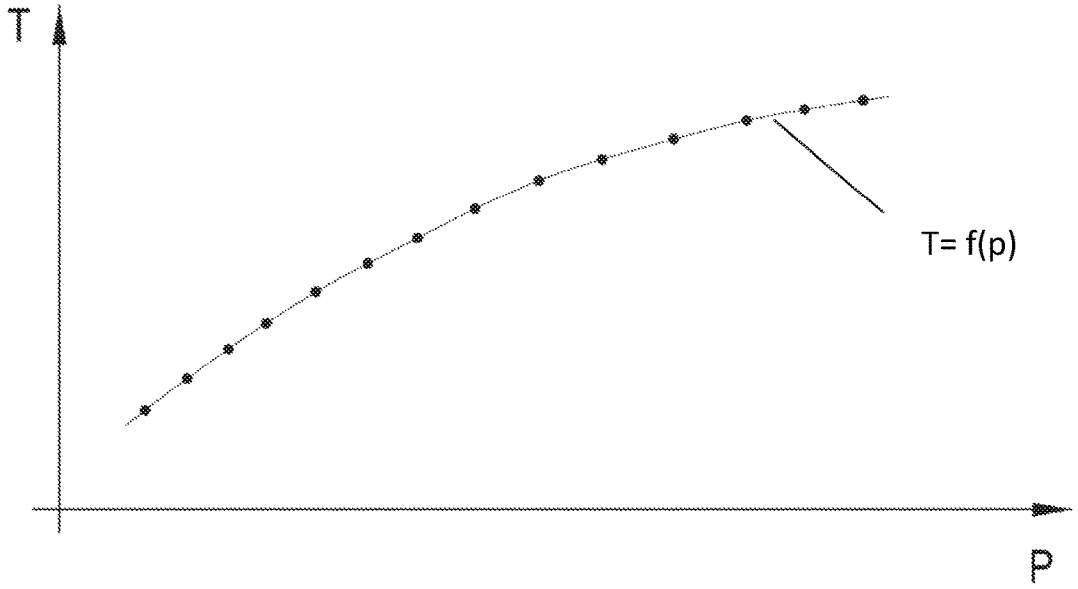
FIG. 5 shows the behavior of the temperature threshold as a function of the feeding pressure of the organic fluid, as in the previous figures.

To easier implement this temperature-pressure curve in the system control software, it can be advantageous to interpolate such a discrete curve with an algebraic function T=f(p), as shown in FIG. 5. It has to be remarked that, increasing the pressure also the temperature value at the turbine inlet must be progressively increased, to avoid the risk that the expansion curve intersects the saturation curve.

Figure 6:
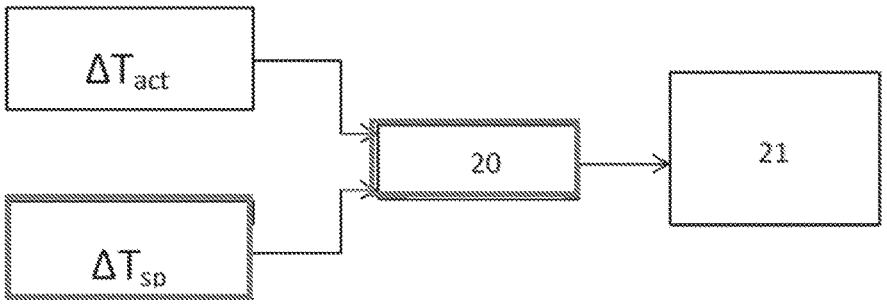
FIG. 6 shows a block diagram of the control of the "similar to an overheating" temperature according to an embodiment of the present method.

Therefore, the control apparatus (a possible embodiment of which is shown in FIG. 6 performs a cycle adjustment to keep the parameter "similar to an overheating" equal to the predetermined set point. The adjustment is typically performed by acting on the flow rate of the organic fluid entering the heat exchangers, which heats and vaporizes said fluid. More in detail, the predetermined set point value ΔTsp is compared with the current "similar to an overheating" parameter ΔTact (the adjusted variable) and the control action is carried out by a controller 20, for example a PID controller (proportional, integral and derivative), whose output is the adjustment 21 of the control variable, that is to say the flow rate of the fluid entering the heat exchangers. Usually, this set point ranges between a few degrees and increments of ten degrees and consequently a high accuracy in calculating the above mentioned points of the curve and/or interpolating said curve is not required.

The map associating a temperature threshold to each pressure value of the vapor in the turbine is predetermined and is an input parameter of the control method.

As an example, the control action can be related to the rotational speed V of the feed pump 2 or to the opening degree X of a valve, located downstream of said feed pump (working the pump at a fixed revolution number) or to another control parameter, influencing the parameter to be adjusted (for example, the hot source temperature).

In case of organic fluids having the right branch of the saturation curve either with a small positive slope or even with a small negative slope, the intersection of the saturation curve can arise in the lower portion of the right branch of the T-S diagram, corresponding to lower condensation pressures. For the same fluid, starting from the same evaporation pressure, such a phenomenon does not appear at higher condensation pressures. Therefore, for such fluids the threshold temperature values can be more conveniently corrected as a function of the condensation pressure.

The present method can also be suitable for a slow ramp up of the system. In fact, beginning the starting phase with substantially high values of the temperature difference ΔT would lead to a quite low pressure values in the turbine: the temperature difference value is limited on the upper part by the maximum temperature of the hot thermal source and therefore, increasing the variable ΔT, the maximum pressure value reachable in the ORC cycle decreases. Later, it would be possible to gradually decrease the value of the temperature difference ΔT, until the ORC cycle will reach the target conditions (either subcritical or hypercritical). In this way, for example, the transient phase from a subcritical cycle to a hypercritical cycle can be gradually performed.

Other than the embodiments of the invention, as above disclosed, it is to be understood that a vast number of variations exist. It should also be appreciated that the exemplary embodiment or exemplary embodiments are only examples and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

The invention claimed is:

1. A method of controlling an Organic Rankine cycle (ORC) system, the system comprising:

at least one feed pump (2);

at least one heat exchanger (3), which further comprises a pre-heater, an evaporator and a vapor over-heater;

an expansion turbine (5);

a regenerator (8);

a condenser (6) and a control apparatus;

the organic Rankine cycle comprising:

a feeding phase of an organic working fluid, a heating and vaporization phase of the same working fluid, an expansion and condensation phase of the same working fluid, a regeneration phase;

and wherein said method comprises a ramp-up of the system;

wherein said method comprises controlling an adjusted variable (X), which is a function of an overheating of the organic fluid by varying a control variable (Y), which is a parameter of the organic fluid in its liquid phase, and wherein said control apparatus performs a cycle adjustment to keep said variable (X) equal to a predetermined set point, said cycle adjustment is performed by acting on a flow rate of the organic fluid entering said at least one heat exchanger (3) which heats and vaporizes said organic fluid;

wherein said flow rate is adjusted by varying at least one feed pump (2) rotational speed or by adjusting a valve opening, said valve is located downstream of said at least one feed pump (2);

and wherein said adjusted variable (X) is a temperature difference (ΔT) between a current temperature of the organic fluid in vapor phase at a turbine inlet and a temperature threshold (Tlim) under which said expansion and condensation phase involves the formation of a liquid phase of the organic fluid, according to a supercritical cycle;

and wherein said expansion phase produces no liquid formation and thus prevents turbine damage.

2. The method according to claim 1, wherein said temperature threshold (Tlim) is a function of the vapor pressure in said expansion turbine (5) and represents a safety margin with respect to a critical condition, which would cause liquid formation during the expansion in the turbine.

3. The method according to claim 1, wherein said control variable (Y) is a flow rate (Q) of the organic fluid at an inlet of said at least one heat exchanger (3).

4. The method according to claim 3, wherein the adjustment of said flow rate (Q) of the organic fluid at inlet of said at least one heat exchanger (3) is realized by varying a rotational speed (V) of the at least one feed pump (2) of the organic fluid.

5. The method according to claim 3, wherein the flow rate (Q) of the organic fluid at the inlet of said at least one heat exchanger (3) is adjusted by varying an opening degree (x) of said valve located downstream of said at least one feed pump of the organic fluid.

6. The method according to claim 1, wherein said regenerator (8) exchanges heat between the organic fluid in a liquid phase, flowing from said at least one feed pump (2) to said at least one heat exchanger (3), and the organic fluid in vapor phase flowing towards the condenser (6).

7. The method according to claim 1, wherein said ramp up of the system is carried out by:

beginning a starting phase with high values of a temperature difference (ΔT) which would lead to low pressure values in the turbine;

limiting the temperature difference (ΔT) by varying a maximum temperature of a hot thermal source and therefore, by increasing the temperature difference (ΔT), the maximum pressure value reachable in the Organic Rankine cycle (OCR) decreases;

gradually decreasing the value of the temperature difference (ΔT), until the Organic Rankine cycle (OCR) reaches target conditions, either subcritical or hypercritical, achieving that a transient phase from a subcritical cycle to a hypercritical cycle can be gradually performed.

8. A control apparatus for controlling an Organic Rankine cycle (ORC) system, said control apparatus comprising:

an Electronic Control Unit (ECU);

a controller (20);

a data carrier associated to said Electronic Control Unit, and a computer program configured for performing the method according to claim 1 and wherein said computer program is stored on a computer program product in the data carrier;

and wherein the controller (20) is a PID (Proportional, Integral and Derivative) controller having as output an adjustment of the flow rate of the organic fluid entering said at least one heat exchanger (3).

* * * * *